US006138592A

United States Patent [19]

Seneff

[11] Patent Number: 6,138,592

[45] Date of Patent: Oct. 31, 2000

[54] APPARATUS FOR APPLYING FRAMES TO FABRIC

[76] Inventor: Robert W. Seneff, W224 N2829 Stonewood Ct., Waukesha, Wis. 53186

[21] Appl. No.: 09/224,753

[22] Filed: Jan. 4, 1999

[51] Int. Cl.[7] ..... D05C 9/12; D05C 3/08; D06C 3/08

[52] U.S. Cl. ..... 112/103; 38/102.2

[58] Field of Search ..... 112/103, 470.14; 38/102, 102.2, 102.4, 102.91

[56] References Cited

U.S. PATENT DOCUMENTS

| | | | |
|---|---|---|---|
| 662,982 | 12/1900 | Stevens . | |
| 1,294,713 | 2/1919 | Runnette . | |
| 2,188,433 | 1/1940 | Friese | 29/89 |
| 2,190,582 | 2/1940 | Wolf | 88/56 |
| 2,362,185 | 11/1944 | Brammer | 29/235 |
| 2,533,870 | 12/1950 | Bayer | 81/7 |
| 2,753,897 | 7/1956 | Conrad | 140/109 |
| 3,099,875 | 8/1963 | Lelis | 29/227 |
| 3,584,362 | 6/1971 | Hazel et al. | 29/203 MM |
| 3,608,179 | 9/1971 | Jeffree et al. | 29/446 |
| 3,705,454 | 12/1972 | Zuhlke et al. | 29/208 |
| 3,863,368 | 2/1975 | Vasilantone | 38/102.91 X |
| 3,871,055 | 3/1975 | Dail | 29/267 |
| 3,874,058 | 4/1975 | Jesevich et al. | 29/208 D |
| 4,538,335 | 9/1985 | Moore, III | 29/251 |
| 4,561,177 | 12/1985 | Rancer | 29/721 |
| 4,598,488 | 7/1986 | Inteso | 112/103 X |
| 4,606,280 | 8/1986 | Poulton et al. | 108/97 |
| 4,620,352 | 11/1986 | Sulej | 29/251 |
| 4,767,111 | 8/1988 | Guenther | 269/303 |
| 4,774,778 | 10/1988 | Williams | 38/102.2 |
| 4,805,297 | 2/1989 | Seneff | 29/721 |
| 4,875,268 | 10/1989 | Szarka | 29/283 |
| 4,910,894 | 3/1990 | Vartan | 38/30 |
| 4,955,765 | 9/1990 | Laird | 408/87 |
| 5,016,367 | 5/1991 | Breen et al. | 38/135 |
| 5,432,990 | 7/1995 | Seneff | 29/251 |
| 5,590,613 | 1/1997 | Head | 112/103 |
| 5,664,350 | 9/1997 | Moore, III | 38/102.2 |

FOREIGN PATENT DOCUMENTS

| | | | |
|---|---|---|---|
| 7805887 | 2/1979 | Netherlands | 248/176 |
| 452827 | 5/1968 | Switzerland | 108/90 |
| 917378 | 3/1982 | U.S.S.R. | 29/281.4 |

OTHER PUBLICATIONS

IBM Technical Disclosure Bulletin, vol. 26, No. 7A, Dec. 1983 Grospin, Hassebrook & Shlatz.

"MacFrame Puts Tension in it Place . . . " flyer of Macpherson, Inc. P.O. Box 1889, Greensboro, N.C. 27402.

Impressions, vol. 10, No. 9, Jan. 1987, p. 168.

*Primary Examiner*—Ismael Izaguirre

*Attorney, Agent, or Firm*—Quarles & Bradly LLP

[57] ABSTRACT

An improved apparatus for tensioning embroidering fabric between frames has an outer frame half template mounted to a frame assembly so as to maintain alignment with an inner frame half template when the table assembly holding the fabric is repositioned. The inner frame half template holds different sized inner frame halves which can be aligned with corresponding outer frame halves by adjusting the position of locator pins in the inner frame half template. The outer frame half template is adjustable to accommodate circular outer frame halves of different sizes while maintaining a common center point.

10 Claims, 12 Drawing Sheets

APPARATUS FOR APPLYING FRAMES TO FABRIC

BACKGROUND OF THE INVENTION

1. Field of the Invention

This invention relates to an apparatus for placing fabric between two frames to keep the fabric taut during embroidery. More specifically, the invention is an improved apparatus for aligning inner and outer frame halves and maintaining that alignment when the fabric support is repositioned. The invention also maintains a fixed center point for all circular outer frame of different sizes.

2. Discussion of the Prior Art

In preparation for embroidering a fabric article, such as a T-shirt, sweat shirt, jacket, etc., it is usually necessary to hold and tension the area to be embroidered within a frame which has an inner half and an outer half. The frame halves must be properly aligned with each other as well as with the area of the fabric to be embroidered. This has posed a problem in the prior art especially when the location or size of the embroidery varies.

Prior art inventions disclose a fixed outer frame half template centered under a reciprocating inner frame half template and fixed to a table structure. Typically, the outer frame half templates are circular recesses sized to contain an outer frame half. Different sized circular outer frame halves can be inserted in the recessed templates and centered by placing a spacer ring of the necessary thickness inside the recess. Another invention discloses the use of specially designed outer frame halves having opposing ears which fit within mounting brackets. The mounting brackets are adjustable within opposing slots in a work table to accommodate various sized circular outer frame halves. The outer frame halves are centered by manually securing the mounting brackets equal distances from the ends of the slots. Although these inventions accommodate and permit manual centering of various sized circular outer frame halves, the templates are integral with the table supporting the fabric article. Therefore, the fabric article itself must be positioned between the two templates, which makes accurate positioning difficult.

Another invention discloses a split work table the width of which can be adjusted as needed to snugly fit a garment, such as a shirt, to be embroidered. Once the table halves are split to properly fit the garment, the table can be moved laterally to position the area to be embroidered beneath the inner frame half. The positioning is made easier and more accurate by the fit of the garment on the table and an adjustable collar alignment member. The outer frame half is placed on the table beneath the garment without the use of a template so that various sized outer templates can be used. The outer frame half, however, must be manually aligned with the inner frame half template.

For mass production of embroidered articles of clothing, it is desirable to have a machine which can be set-up to quickly align the embroidered area on the machine with a minimum of manual alignment by the machine operator for a range of different types of clothing and positions of the areas of embroidering for the same clothing type. Minimal manual alignment is also desired when changing to frames of different sizes.

SUMMARY OF THE INVENTION

The invention provides an improved apparatus for placing fabric between frames to hold the fabric taut during embroidery. The apparatus has a machine frame to which is mounted a table for supporting the fabric article to be embroidered. The apparatus also has inner and outer frame half templates for holding and aligning the inner and outer frame halves for framing. The inner frame half template is mounted to a downwardly moveable member, such as a pneumatic or hydraulic cylinder, that when activated, frames the fabric by pressing the inner frame half and the fabric into the outer frame half. The table is longitudinally, laterally, and transversely adjustable relative to the inner frame half template. The outer frame half template is supported by the table and mounted to the frame by a transverse arm so that the table is laterally and transversely movable relative to the outer frame half template.

An object of the invention is to more accurately position the embroidered area of a garment by allowing the work table to be adjusted without misaligning the templates. Since the outer frame half template is mounted to the machine frame, rather than the table, the outer and inner frame half templates remain aligned when the table is repositioned. Also, in a preferred embodiment of the invention, a shouldered collar positioner is slidably mounted to the table which allows an operator to snugly fit torso garments around the table. This further aids in accurately positioning the garment area to be embroidered between the frame templates by allowing the operator to adjust the table, rather than the garment itself.

In an alternative embodiment of the invention, the apparatus may include a transverse mounting arm fixed to the machine frame for securing one-size outer frame half template portions. The arm can receive a variety of one-size outer frame half templates laterally centered with the inner frame half template. The table can be repositioned without interfering with the alignment of the templates because the mounting arm is fixed to the machine frame. This embodiment provides the additional advantage of allowing the frame size to altered based on the size of the embroidery.

In another embodiment of the invention, the apparatus has an adjustable outer frame half template so as to accommodate and center different sized circular outer frame halves. Preferably, rotating a center plate between outer plates of the template pivots a mechanical linkage that positions four gripping pins in contact with the outer surface of a circular outer frame half at equal distances from the center of the template. The inner frame half template may also be adjustable to hold and align inner frame halves of different sizes. This embodiment accommodates differently sized inner frame halves and circular outer frame halves and allows easy centering of the inner and outer frame halves within their respective templates.

In the preferred embodiment of the invention, the adjustable outer frame half template is mounted to the machine frame, thereby, maintaining alignment of the templates when the table is repositioned. In this embodiment, the size and location of the embroidering area can be changed by using a different sized frame and repositioning the table, while maintaining a central axis with the inner frame half template. In another embodiment, however, the adjustable outer frame half template may be mounted to the table. In this embodiment, different sized frames can be used on the same embroidering area while maintaining a central axis with the inner frame half template. If the embroidering area is changed by repositioning the table, however, then the templates must be manually aligned. In yet another embodiment, the adjustable outer frame half template is not secured in place, so that it must be manually aligned with the inner frame half template. In any of these embodiments, the adjustable outer frame half template obviates manually centering the outer frame half within the outer frame half template and provides a means for holding the outer frame half during framing.

The foregoing and other objects and advantages of the invention will appear from the following description. In this description reference is made to the accompanying drawings which form a part hereof and in which there is shown by way of illustration a preferred embodiment of the invention. Such embodiment does not necessarily represent the full scope of the invention, however, and reference must be made therefore to the claims for interpreting the scope of the invention.

DETAILED DESCRIPTION OF THE PREFERRED EMBODIMENTS

Figure 1:
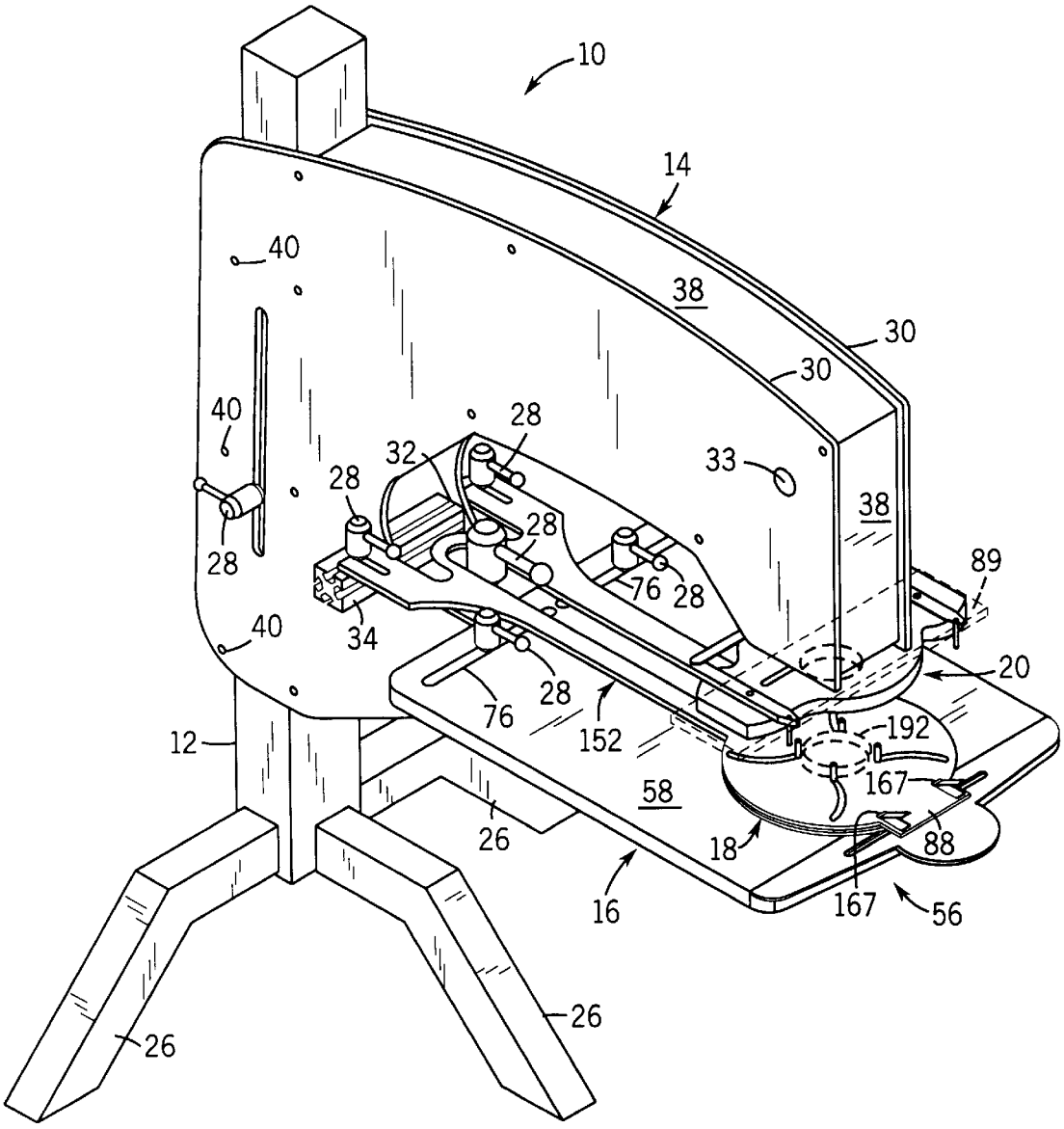
FIG. 1 is a perspective view of a framing apparatus of the present invention with an adjustable size outer frame half template mounted to the machine frame and axially centered with an adjustable size inner frame half template, showing inner and outer frame halves (in phantom lines)
Figure 2:
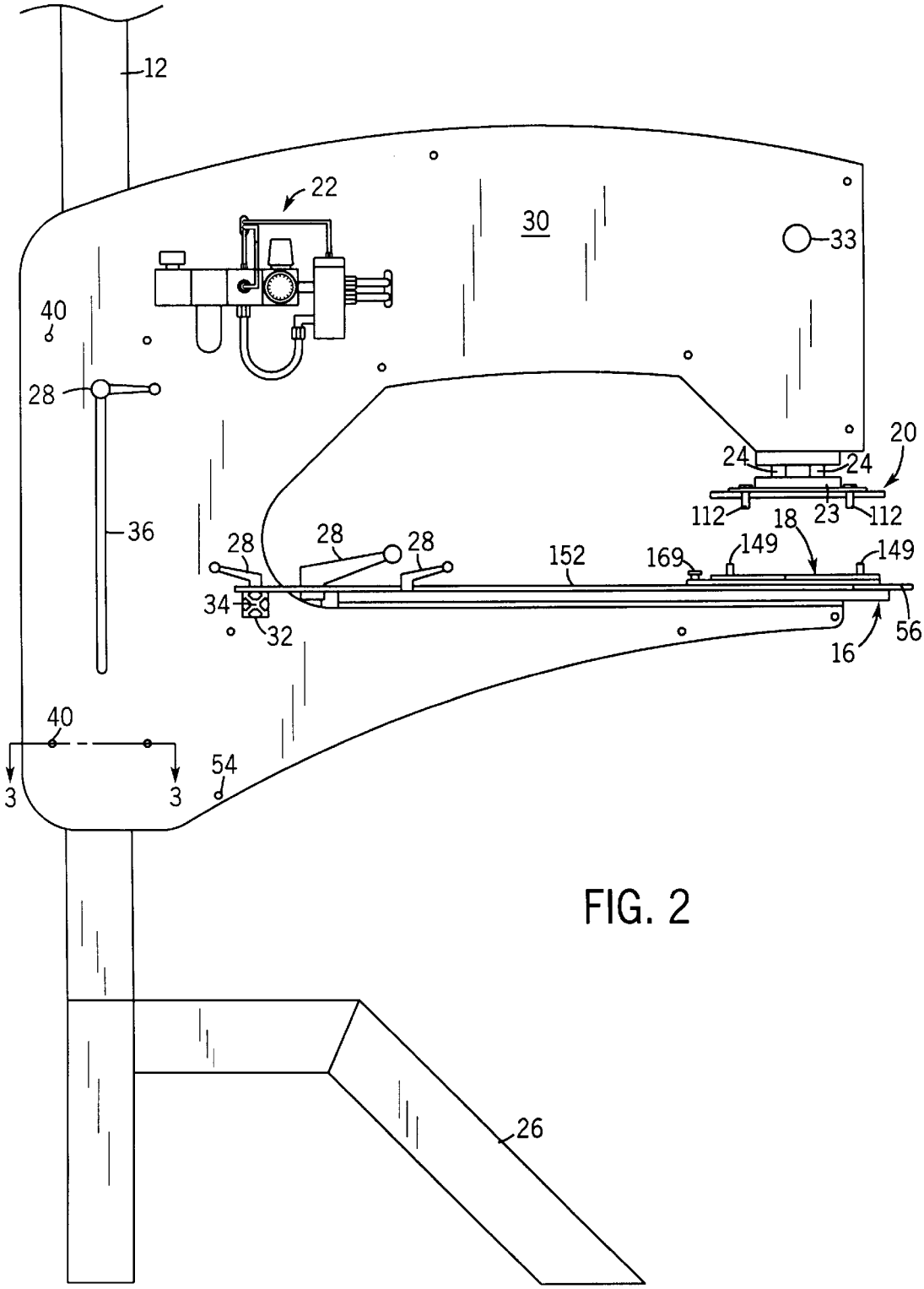
FIG. 2 is a side view of the framing apparatus of FIG. 1.

FIG. 1 illustrates an apparatus of the present invention including a machine frame 10 having a stand 12 adjustably supporting a head assembly 14 to which is mounted a table 16, an outer frame half template assembly 18 and an inner frame half template assembly 20 respectively holding outer frame half 192 and inner frame half 89 (shown in phantom). Referring to FIG. 2, the apparatus also has an air circuit that includes a foot valve (not shown) and an air regulator 22 for controlling a pneumatic cylinder (not shown). The pneumatic cylinder has a pressure plate 23 fixed at the lower end of piston rods 24 for holding the outer frame half template 20. The pneumatic cylinder, air circuit and pressure plate 23 may be as described in U.S. Pat. No. 4,805,297 which issued on Feb. 21, 1989 to the applicant hereof, the entire disclosure of which is hereby incorporated by reference, or of any other suitable construction. In alternative embodiments the pneumatic cylinder and air circuit can be replaced by a hydraulic system or a mechanical lever system as described in U.S. Pat. No. 4,561,177, which is also hereby incorporated by reference.

Referring again to FIG. 1, the stand 12 has angled legs 26 welded proximate its lower end. The stand 12 is made of a hollow tube, preferably stock tube steel having a three inch by four inch lateral cross-section and a length sufficient to position the head assembly 14 at a height suitable for a human operator. The stand 12 has a set of threaded bores (not shown) in opposing transverse sides proximate their longitudinal center in which threaded stud fasteners 28 can be inserted.

The head assembly 14 comprises two transverse side plates 30 that are generally of a squared C-shape and preferably made of 3/16" metal sheets. The side plates 30 have longitudinal slots 36 through the upright portion of the "C", slightly larger that the openings of the stand 12 which receive the threaded stud fasteners 28. The side plates 30 also have square cutout notches 32 sized to hold a length of T-slot block 34 approximately four inches longer than the lateral dimension of the head assembly 14 and having a standard profile made of extruded aluminum, commercially available from Bosch Automation Products of Buchanan, Mich. The side plates 30 also have through bores 33 sized to accommodate two safety start buttons (not shown) connected to the pneumatic cylinder air regulator 22. The side plates 30 are separated by lateral connector plates 38 fastened along various segments of the perimeter of the side plates 30, leaving openings for the stand 12 to extend between the side plates 30 at one end. The connector plates 38 have a width slightly larger than the lateral dimension of the stand 12 and preferably are made of the same material as the side plates 30. Also, referring to FIG. 3, the side plates 30 have three sets of longitudinally separated spacer bores 40 located at equal transverse distances from the side plate slots 36, in which button head screws 42 are inserted that fasten to threaded, steel spacers 44 placed between the side plates 30, as described below.

Figure 4:
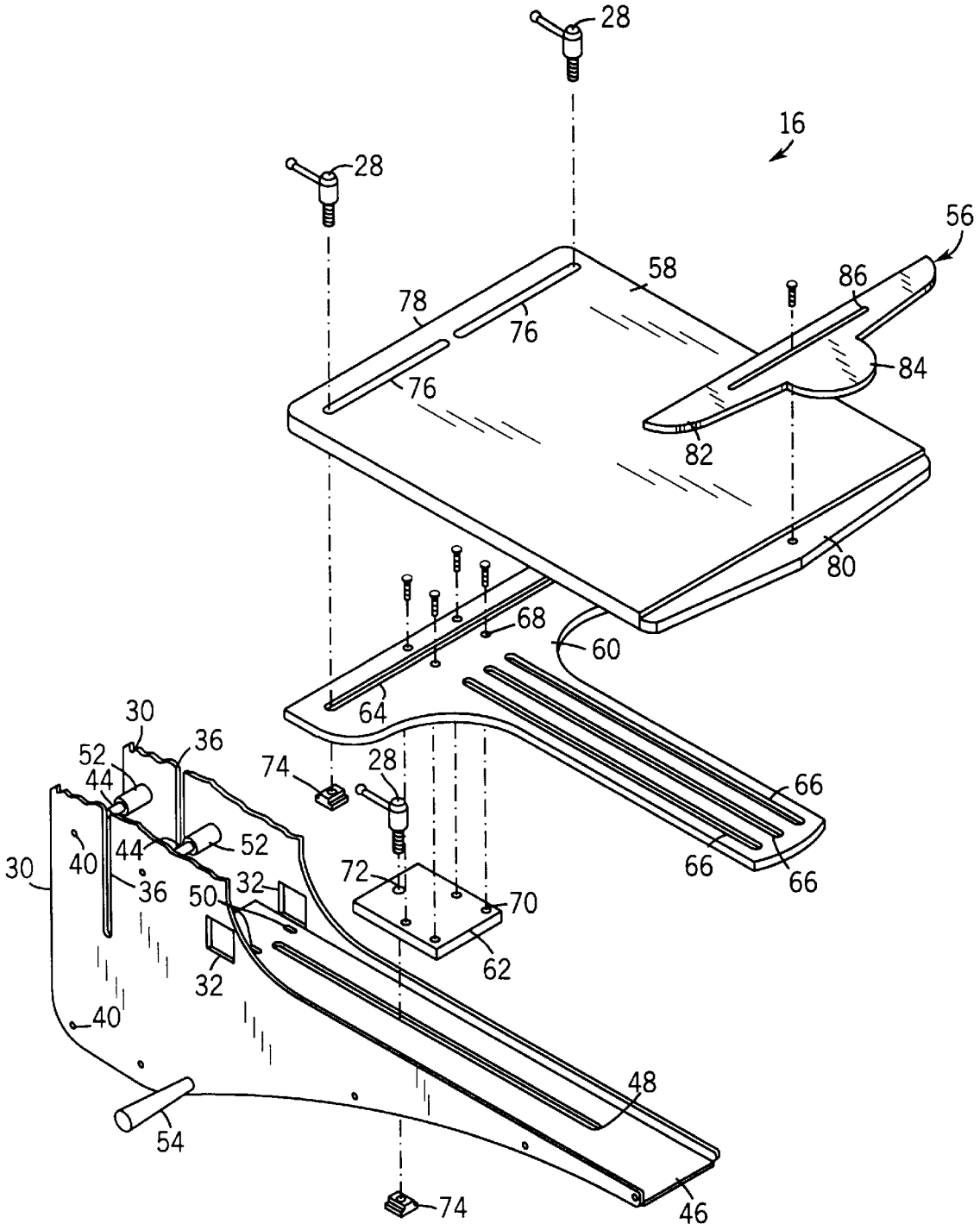
FIG. 4 is an exploded perspective view of the table of the framing apparatus of FIG. 1.

Referring to FIG. 4, the lower leg of the C-shaped side plates 30 are joined by a lateral table support plate 46 which is welded or otherwise suitably fastened between the side plates 30. The table support plate 46 has a central slot 48 extending transversely approximately twelve inches. The table support plate 46 also has two elongated bores 50 that, when assembled, align with bores (not shown) in the T-slot block 34 that is fit within the square notches 32 in the side plates 30. Fasteners placed through the elongated bores 50 secure the T-slot block 34.

The side plates 30, spaced apart and joined by the spacers 44 and lateral plates 38, 46, partially enclose the air regulator 22, pneumatic cylinder and other portions of the air circuit, as shown in FIG. 2.

Figure 3:
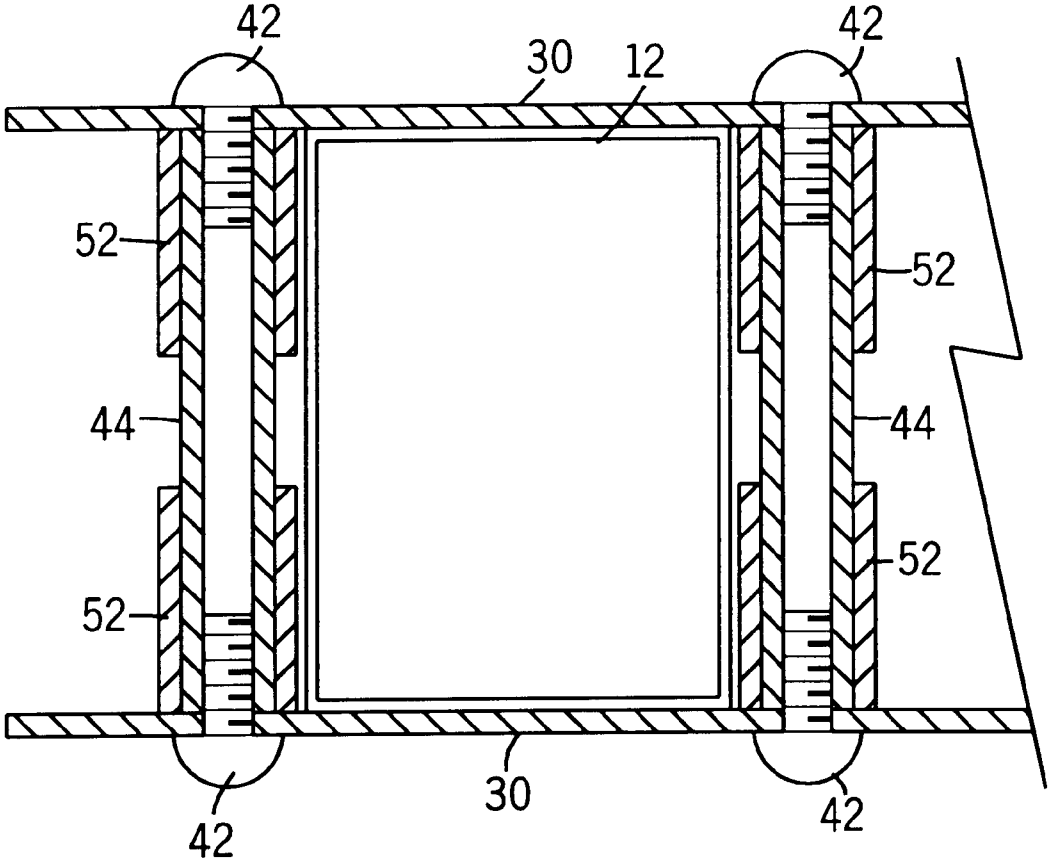
FIG. 3 is a sectional view showing the connection of the head assembly and the stand of the framing apparatus of FIG. 1.

Referring to FIGS. 1, 2 and 3, the head assembly 14 is mounted to the stand 12 by sliding stand 12 through the channel formed by the side plates 30 and the spacers 44. During assembly, the spacers 44 are inserted into bronze bushings 52 which facilitate sliding the head assembly 14 along the stand 12. The threaded stud fasteners 28 are inserted through the side plate slots 36 and are threaded into holes in the stand 12. Handles 54 are welded or otherwise fastened to the side plates 30 to facilitate adjusting the height of the head assembly 14. The height of the head assembly 14 may then be adjusted as desired by holding on to the handles 54, raising or lowering the head assembly 14 and tightening fasteners 28 to secure the head assembly 14 at the desired position.

As shown in FIG. 4, slidably mounted to the table support plate 46 is a table assembly 16 having a collar positioner 56, a work table 58, a sleeve subtable 60, and a mounting plate 62. The sleeve subtable 60 is generally T-shaped having a lateral slot 64 and three transverse slots 66 respectively centered on the lateral and transverse segments of the subtable 60. The subtable 60 also contains through bores 68 through which fasteners are inserted to secure the subtable 60 to the mounting plate 62. The mounting plate 62 has threaded bores 70 to receive the fasteners securing the subtable 60 and a through bore 72. The mounting plate 62 rests on the table support plate 46 and fits between the side plates 30 so that it cannot be rotated. A threaded stud fastener 28 is inserted into the through bore 72 and the table mount slot 48 and threaded into a standard T-nut 74 which fits within the table mount slot 48 on the side of the table support plate 46 opposite from the mounting plate 62. The mounting plate 62 and subtable 60 may then be transversely adjusted and secured in the desired position by tightly threading fastener 28 into T-nut 74.

The generally rectangular work table 58, preferably made of ¾" thick plastic material such as polypropylene, has two lateral slots 76 positioned end to end at a back end 78. The work table 58 rests on the subtable 60 and fasteners 28 fit through slots 64 and 76 of the subtable and table, respectively, and are threaded into T-nuts 74 fit within the lateral subtable slot 64 on the side opposite from the work table 58. The work table 58 may be slid laterally relative to the subtable 58 and secured at the desired position by tightening the threaded stud fasteners 28. The work table 58 has a V-shaped stepped front end 80 of decreased thickness on which rests the collar positioner 56. The collar positioner 56 is preferably made of steel the same thickness as the recess in the stepped front end 80. The collar positioner 56 has a shoulder portion 82 extending the lateral dimension of the work table 58 and a semi-circular neck portion 84 protruding from the center of the shoulder portion 82 with a diameter approximating that of a shirt collar. The shoulder portion 82 has a lateral slot 86 through which a fastener is inserted and threaded into a threaded bore at the lateral center of the stepped front end 80 of the work table 58. The collar positioner 56 may be adjusted laterally relative to the table 58 and secured at the desired position to snugly fit the garment around the table 16.

The work table 58 may be removed by removing the threaded fasteners 28 in slots 76, so that the sleeve table 60 may be used. The sleeve subtable 60 may be adjusted transversely, as described above, and used when embroidering shirt sleeves, pant legs or like garments.

Figure 5:
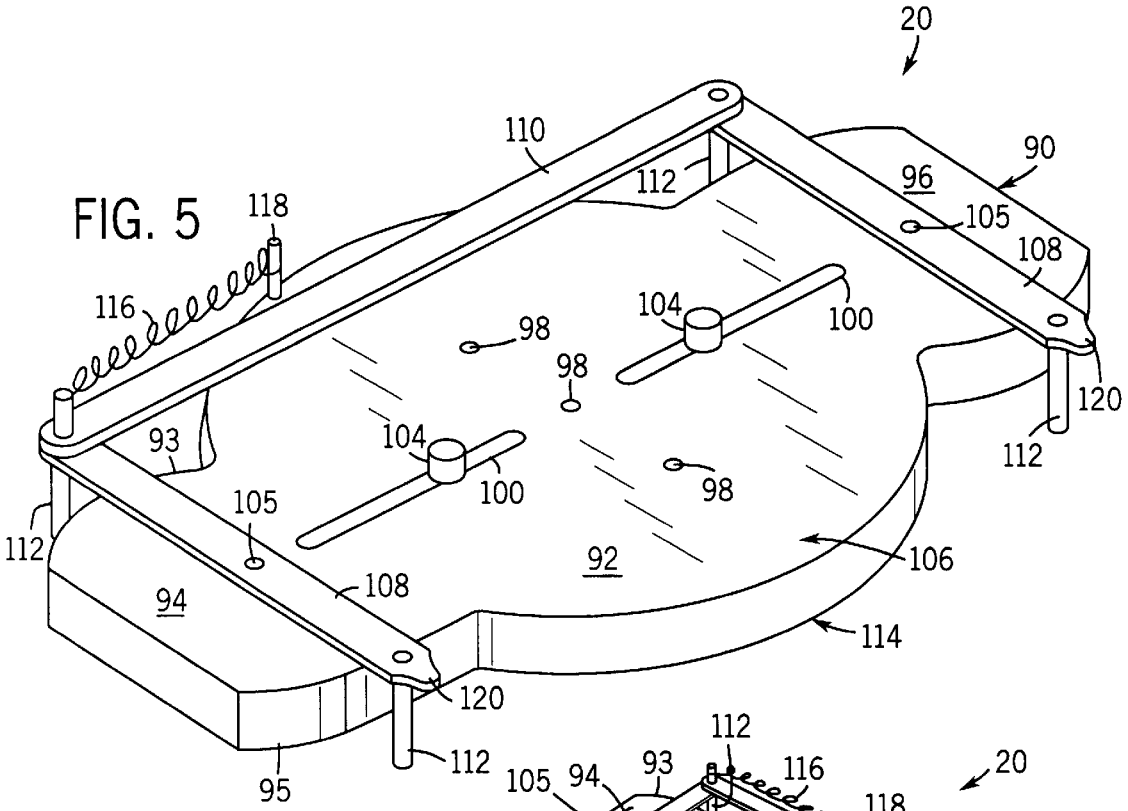
FIG. 5 is a perspective view of the adjustable size inner frame half template of the framing apparatus of FIG. 1.
Figure 6:
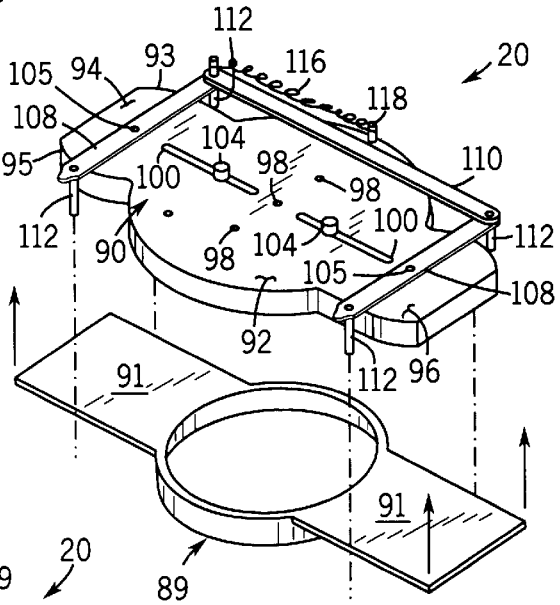
FIG. 6 is a perspective view of the adjustable size inner frame half template of FIG. 5 showing mounting of an inner frame half.
Figure 7:
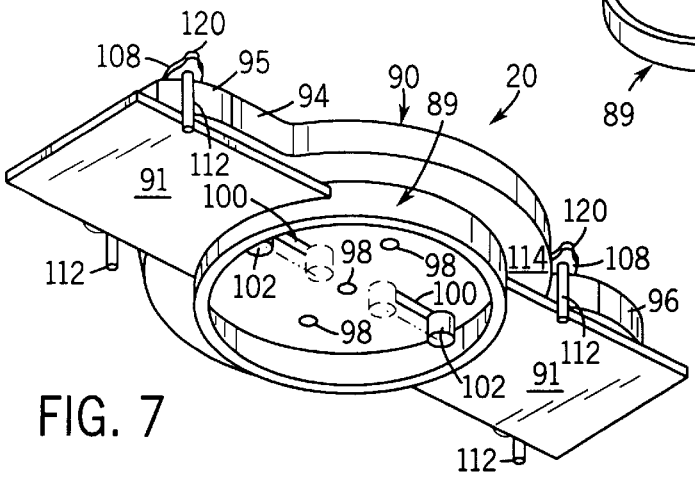
FIG. 7 is a perspective view of the adjustable size inner frame half template of FIG. 5 showing a mounted inner frame half.

FIGS. 5, 6 and 7 illustrate the outer frame half template 20 fastened to the pressure plate 23 and mounted on the pneumatic cylinder pistons 24. The inner frame half template 20 comprises a circular winged plate 90 defining a profile having a circular center portion 92 and first 94 and second 96 lateral wings. The arcuate back edge 93 of the first wing 94 joins a straight transverse edge with the circular center portion 92. The rounded front corner 95 of the first wing 94 joins straight edges in the lateral and transverse directions. The profile of the second wing 96 is the reverse mirror image of the profile defined by the first wing 94. Spaced along the central transverse axis of the winged plate 90 are three through bores 98 through which threaded fasteners are inserted to mount the outer frame half template 20 to the piston pressure plate 23 (FIG. 2). Spaced along the central lateral axis of the winged plate 90 are two slots 100 through each of which is inserted a threaded locator member 102 (such as a threaded spacer) that is threaded onto a bolt 104. Pivotally fixed at pivot points 105 to a first surface 106 of the winged plate 90 proximate the center of each wing 94, 96 is a transverse link 108 pivotally connected to a lateral cross-link 110 proximate the rear ends of the links 108. Proximate the end of links 108 are holding pins 112 extending longitudinally (vertically) past a second surface 114 approximately ¼". An extension spring 116 joins a mounting post 118 located proximate the back edge of the central circular portion 92 to the holding pin 112 located at the back end of the transverse link 108 on the first wing 94. The front edge of the links 108 have a tapered convex profile 120 providing an ergonomic profile for manually pivoting the links 108 against the bias of the spring 116.

Figure 8:
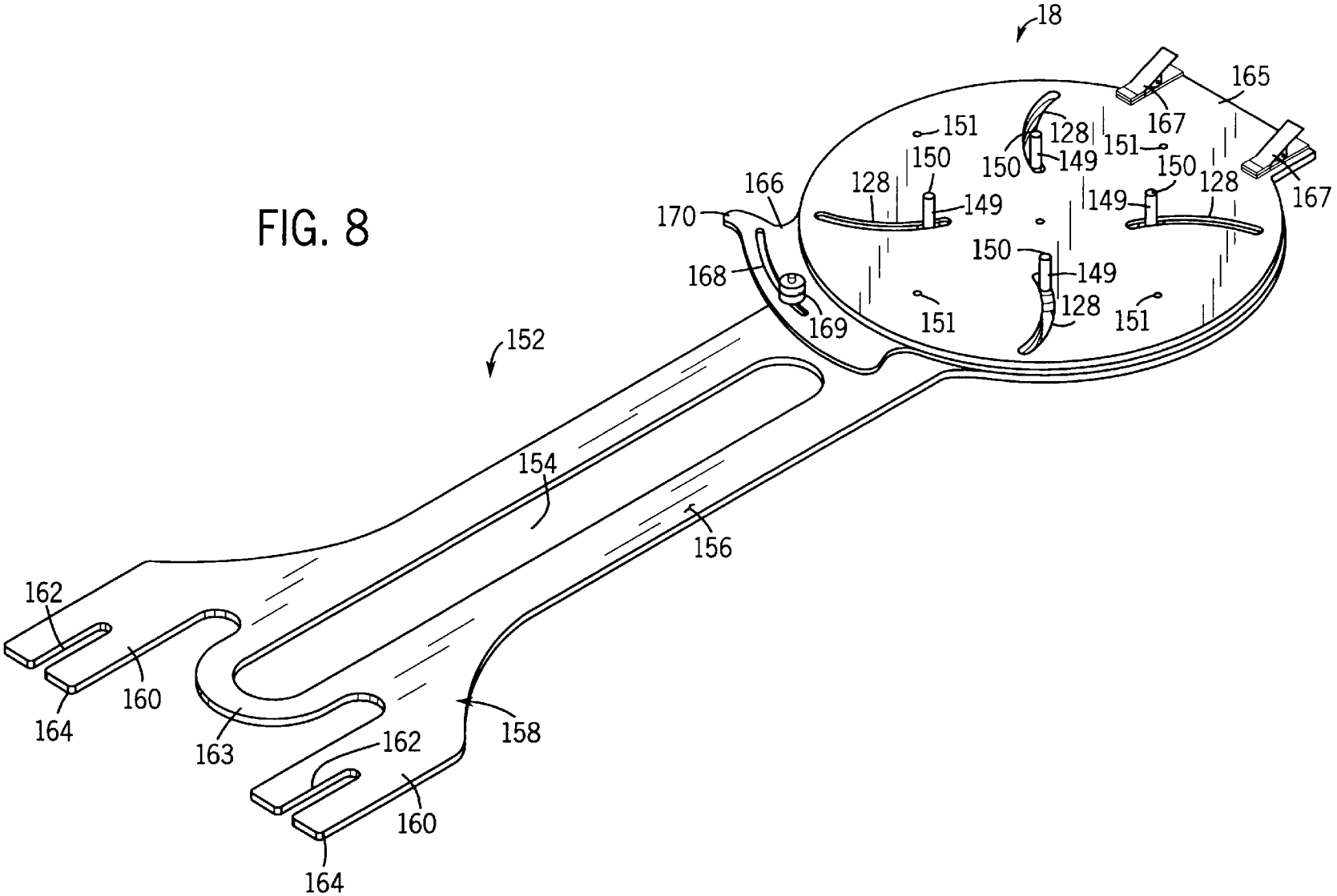
FIG. 8 is a perspective view of the adjustable size outer frame half template of the framing apparatus of FIG. 1 with a frame mounting arm.
Figure 9:
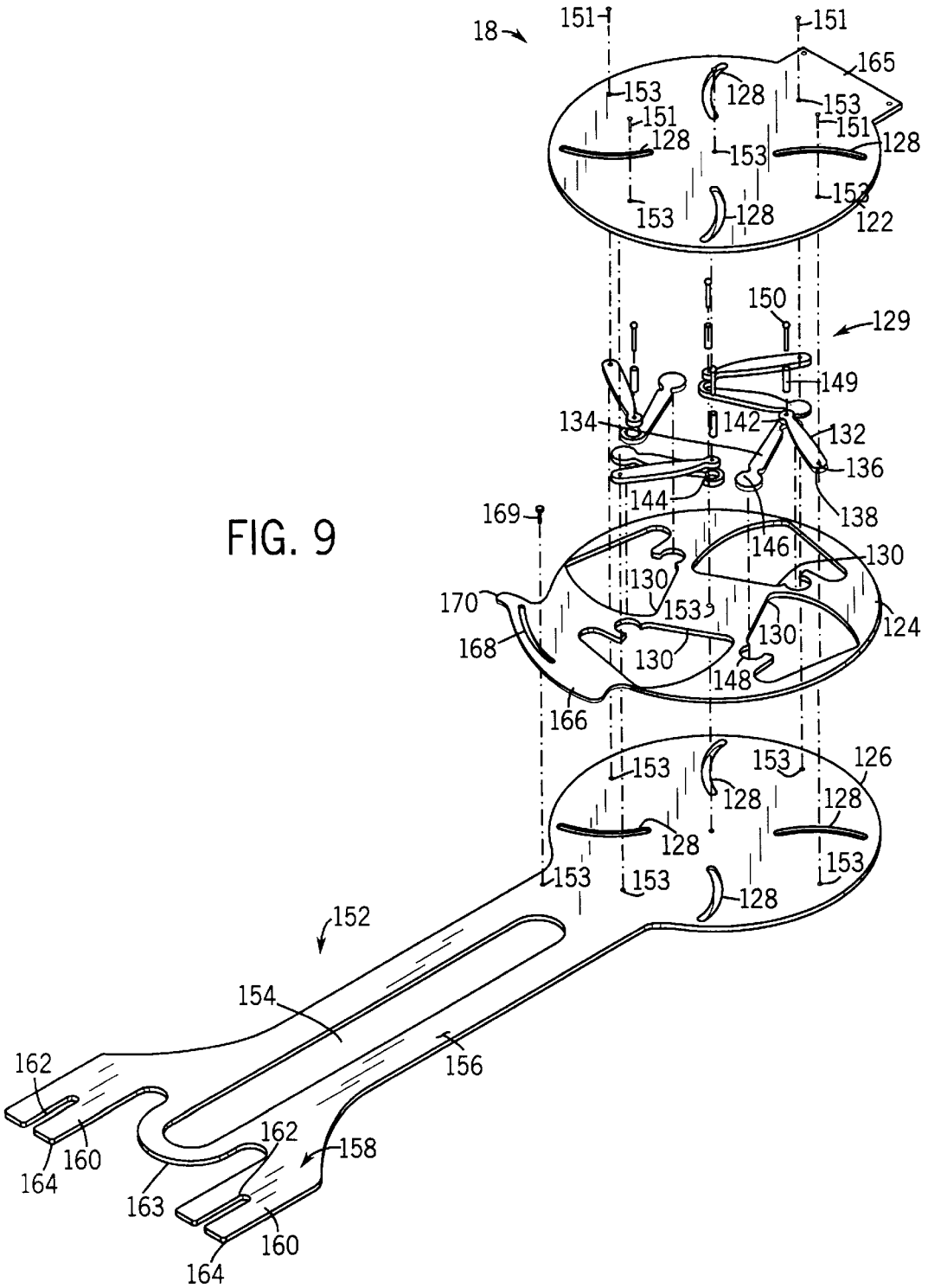
FIG. 9 is an exploded perspective view of the adjustable size outer frame half template of FIG. 8.

FIGS. 8 and 9 illustrate the outer frame half template assembly 18 adjustable to accommodate and center different sized circular outer frame halves 192 (see FIG. 1). Preferably, the outer frame half template is adjustable to hold outer circular frames 192 up to standard size 18. The outer frame half template assembly 18 comprises first 122, second 124 and third 126 slotted disks or plates. The plates 122, 124, 126 are generally circular aluminum disks approximately ⅛" thick and ten inches in diameter. The first plate 122 supports outer frame halves 192, the second plate 124 is used to guide and adjust a linkage 129 and the third plate 126 supports the linkage 129 and first 122 and second 124 plates. The first 122 and third 126 plates have four identical arcuate slots 128 arcing in a clock-wise direction from the centers to the edges of the plates 122, 126 and centered on holes 153 proximate the center of each quadrant of the lateral-transverse plane fixed at the center of the plates 122, 126.

Referring to FIG. 9, the second plate 124 has four generally fan-shaped linkage profiles 130 cut out, each to contain first 132 and second 134 links, having slightly decreased thicknesses. Each link 132 has a through bore 136 proximate a fixed pivot end 138 and a circular, translating pivot end 142 that is trapped by and pivots within a hooked, translating pivot end 144 of the second link 134. Opposite the hook pivot end 144 is a circular pivot point 146 that is trapped by and pivots within an arced section 148 of the corresponding linkage profile opening 130. Tubular grips 149 fit over the shaft of threaded fasteners 150 which are inserted through holes 143 in the circular ends 142 and threaded into nuts (not shown) below the end 142, the nuts sliding in the slots 128.

To assemble the outer frame half template assembly 18, the third plate 126 is set on a flat surface and the second plate 124 is placed on top of the third plate 126. The circular end 146 of one of the second links 134 is fit within the arced portion 148 of each profile 130 so as to be pivotally captured thereby. The circular end 142 of one of the first links 132 is then fit within the hooked end 144 of each of the second links 134 to be pivotally captured thereby. The second 124 and third 126 plates are adjusted so that the nut (not shown) holding the spacer 149 fits within the arced slots 128 of the third plate 126. Then, the first plate 122 is placed over the second plate 124 with the grips 149 protruding through the arced slots 128 of the first plate 122. Each plate 122, 124, 126 has a central bore, and the first 122 and third 126 plates have four bores proximate the circumference along the lateral and transverse axes. Threaded fasteners 151 are inserted through the bores 153 in the first plate 122 through the bore 136 of the first links 132 and threaded into the bores of the third plate 126. The fasteners are tightened so as to hold the plates together but allow the second plate 124 to rotate between the first 122 and third 126 plates. As the second plate 124 is rotated, the linkage profiles 130 cause the links 132, 134 to pivot, thereby simultaneously moving the grips 149 an equal distance along the arcuate slots 128.

Extending integrally from a segment of the circumference of the third plate 126 is a forked mounting arm 152. The mounting arm 152 has a central transverse slot 154 extending from proximate the third plate 126 through a narrower middle portion 156 to proximate a mounting end 158. At the mounting end 158, the outer profile of the mounting arm 152 widens and terminates at two tines 160 with central slots 162 extending to the edge 164 of the tines 160. The inner profile of the mounting end 158 generally forms a W-shape, with a rounded middle portion of the "W" joining the two tines 160 and closing the slot 154. The lateral dimension of the mounting end 158 inner profile is slightly greater than the lateral dimension of the head assembly 14.

To mount the outer frame half template 18 to the frame 10, the outer frame half template assembly 18 is rested on the work table 58. The tines 160 of the mounting arm 152 are positioned around the side plates 30 of the head assembly 14. Fasteners 28 are threaded into T-nuts 74 inserted into each end of the top groove in T-slot block 34. The grooves 162 in the tines 160 are slid around the studs of fasteners 28 and adjusted laterally and transversely until the outer frame half template 18 is aligned with the inner frame half template 20. The transverse slot 154 in the mounting arm 152 is sized to receive and allow the fastener 28 protruding from the table mounting plate 62 to slide within the slot 154 as the table assembly 16 is transversely adjusted.

The first plate 122 may be provided with a tab portion 165 having two spring-loaded retaining clips 167 for holding down backing material (not shown), which may be used to back up the embroidery. The second plate 124 has a tab portion 166 having an arcuate slot 168 and a tapered corner 170 forming a gripping point for rotating the second plate 124. A threaded fastener 169 is inserted through the slot 168 and threaded into a threaded bore 153 in the mounting arm 152.

When embroidering, for example a shirt, the framing apparatus is operated by a machine operator inserting inner 89 and outer 192 frame halves into the respective templates 18, 20, positioning the garment as desired, and pressing the inner frame half 89 within the outer frame half 192. The operator must first position the locator pins 102 appropriately for the given size inner frame half 89. Then, holding on to tapered end 120, the operator pivots the linkage in the inner frame half template 20, inserts an inner frame half 89 and releases the end 120. Releasing the tapered end 120 allows the extension spring 116 to force the holding pins 112 against the edges of the planar wings 91 of the inner frame half 89, thereby holding it in place.

Holding on to tab 166, the operator rotates the second plate 124 of the outer frame half template assembly 18 clockwise until the spacers 149 are outside of an outer frame half 192 placed on the template assembly 18. Threaded fastener 169 is loosened, the second plate 124 is then rotated counter-clockwise until all spacers 149 contact the radial outer surface of the outer frame half 192, and the threaded fastener 169 is tightened. At this point, both frame halves should be aligned. If desired, backing material may be placed over the outer frame half 192 and held in place by retaining clips 167. The garment is then placed over the table 16 and outer frame half template 18 assemblies. The operator slides the collar positioner 56 as necessary to snugly fit the garment to the work table 58. Then, the work table 58 is adjusted laterally and transversely as needed by loosening the fasteners 28 securing the work table 58 and/or the table mounting plate 62 and refastening once the garment is properly positioned. The operator then actuates the pneumatic cylinder, forcing the inner frame half template 20 toward the outer frame half template 18 so as to pinch the fabric (and backing material if used) between the inner frame half 89 and the outer frame half 192.

As the inner frame half 89 is inserted into the outer frame half 192, the garment is pulled taut and framed, and the inner frame half template 20 recoils. Framing like garments in like areas using the same size frames requires no additional adjustment of the apparatus. To embroider an area using a different frame size, an outer frame half 192 is inserted into the outer frame half template 18, as described above. Then, the locator pins 102 of the inner frame half template 20 are adjusted (if need be) to equal distances from the ends of slots 100 as necessary to center the inner frame half 89. The remainder of the framing process is as described above.

Figure 10:
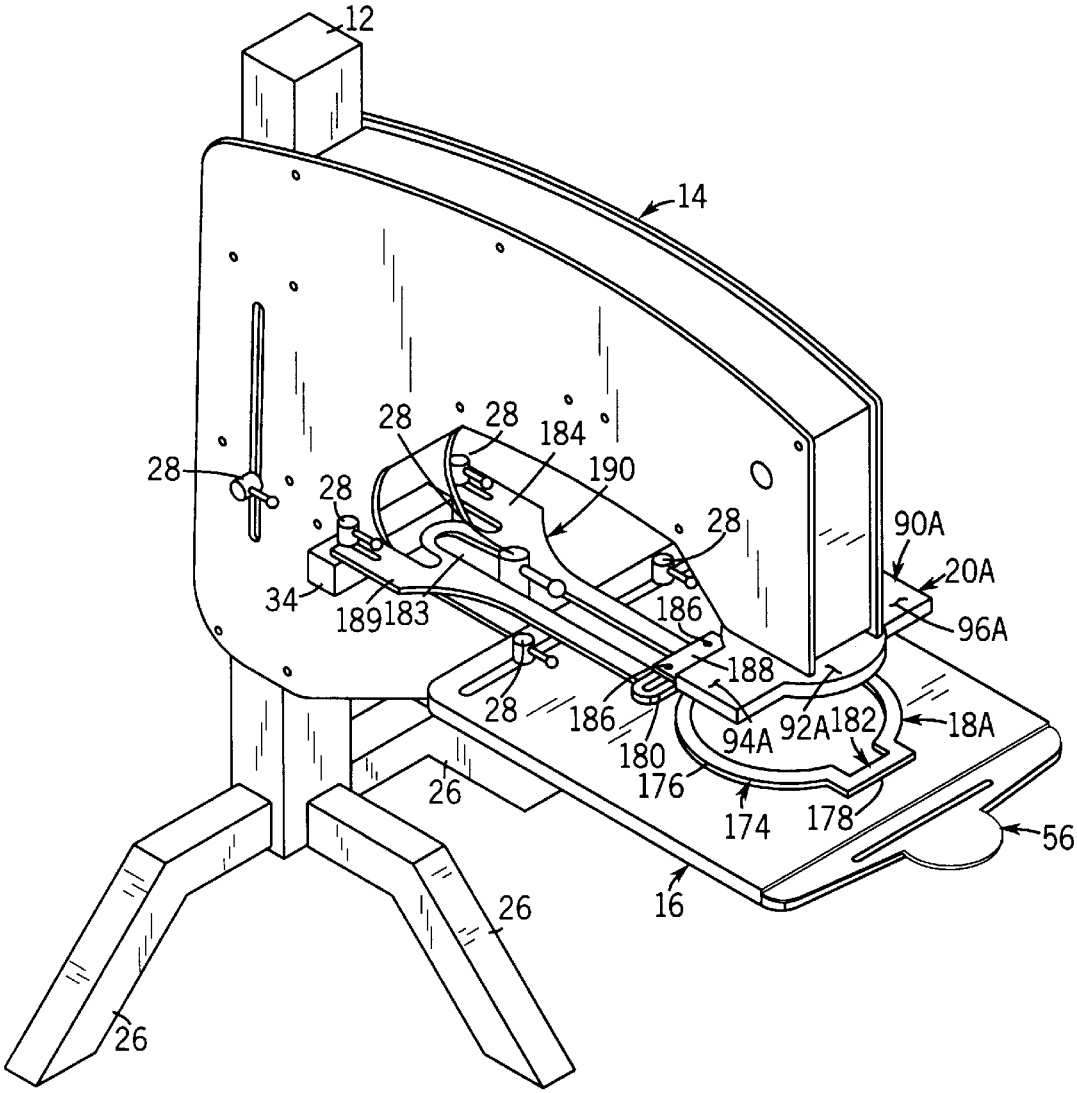
FIG. 10 is a perspective view of a framing apparatus of the present invention with a fixed-size outer frame half template mounted to the machine frame and axially centered with a fixed-size inner frame half template.

In an alternative embodiment, shown in FIG. 10, outer 18A and inner 20A frame templates accommodate only one frame size. The apparatus has a frame comprising a stand 12, a head assembly 14, and a table assembly 16. Mounted to the pneumatic cylinder pressure plate 23 is an outer frame half template 20A comprising a circular winged plate 90A defining a profile having a circular center portion 92A and first 94A and second 96A squared wings. Spaced along the central transverse axis of the winged plate 90A are three through bores (not shown) through which threaded fasteners are inserted to mount the outer frame half template 20A to the piston pressure plate 23. The circular portion 92A has an increased thickness (not shown) with a stepped diameter slightly less than the inner diameter of an inner frame half 89. Any means sufficient to provide a frictional fit, such as the spring detent system described in U.S. Pat. No. 4,805,297, may be used to hold the inner frame half 89 to the template 20A.

The outer frame half template 18A comprises a plastic, preferably polypropylene, template 174 comprising a middle portion 176 and first 178 and second 180 tab portions. The middle portion 174 generally defines the perimeter of an outer frame half, for example circular for a circular frame or oval for an oval frame. The first tab portion 178 defines a recess 182 at an interior edge to fit frame clamp 198. The second tab portion 180 has threaded bores (not shown) located equal distances from a central transverse axis that receive thumb screws 186 inserted through bores (not shown) in a lipped end 188 of a mounting arm 190. This maintains alignment of the inner 20A and outer 18A templates. The mounting arm 190 is fork shaped and has transverse slots in tines 184 at one end (similar to mounting arm 152). The outer frame half template assembly 18A is mounted to the T-slot block 34 as described above. Different sized outer template portions 174 can be used as desired by changing template portions 174 to different sizes, whereby alignment is maintained through the common distance between the threaded bores (not shown) in the templates. Alternatively, smaller sized outer frame halves may be inserted into the template portion 174, maintaining alignment with multiple spacer rings or a spacer ring of the necessary thickness (not shown). This embodiment permits the table to be adjusted without misaligning the templates. The framing process is conducted the same as described as above.

Figure 11:
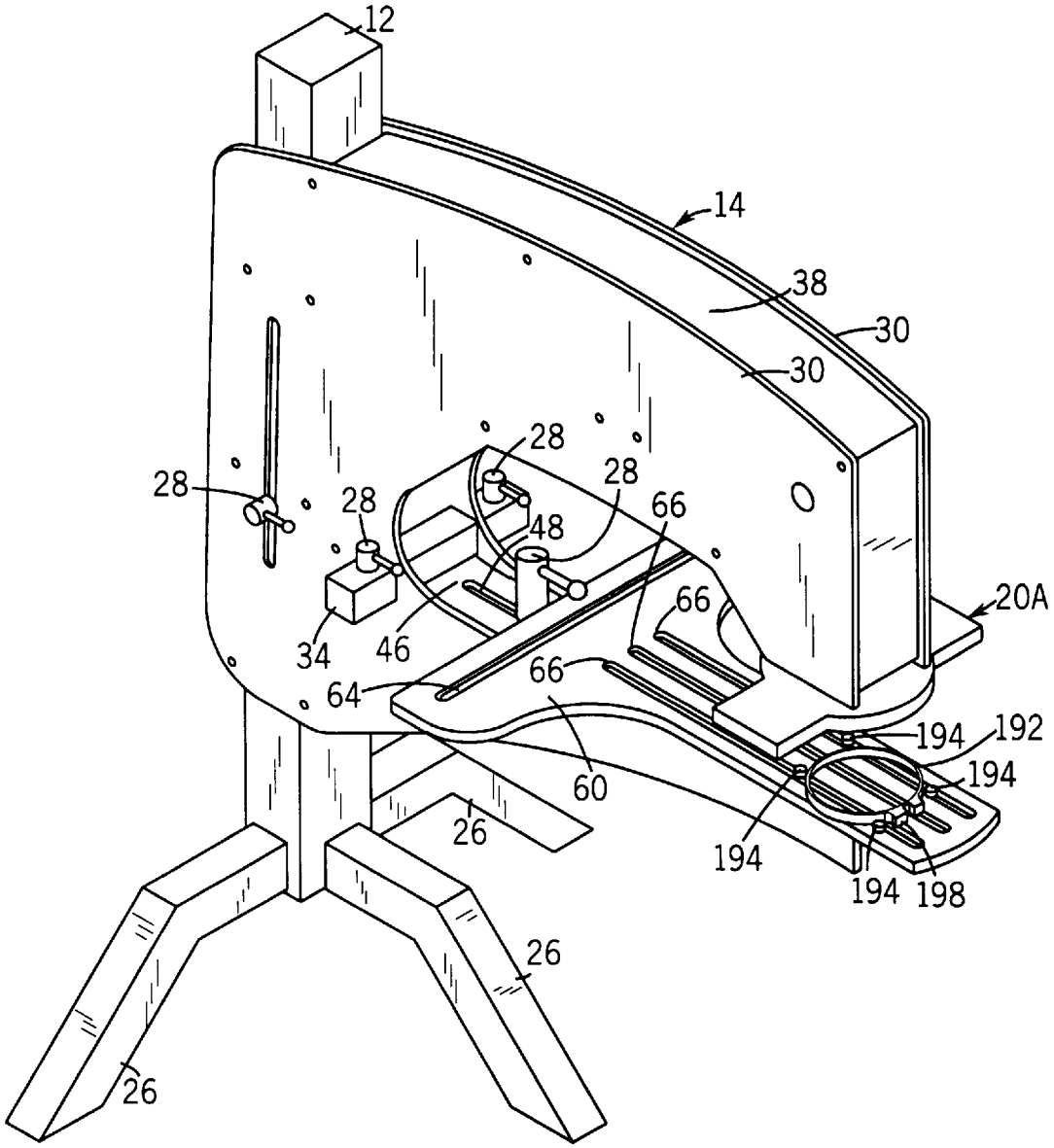
FIG. 11 is a perspective view of the framing apparatus of FIG. 10 showing an outer frame half on a subtable slidable to axially center the inner and outer frame halves.
Figure 12:
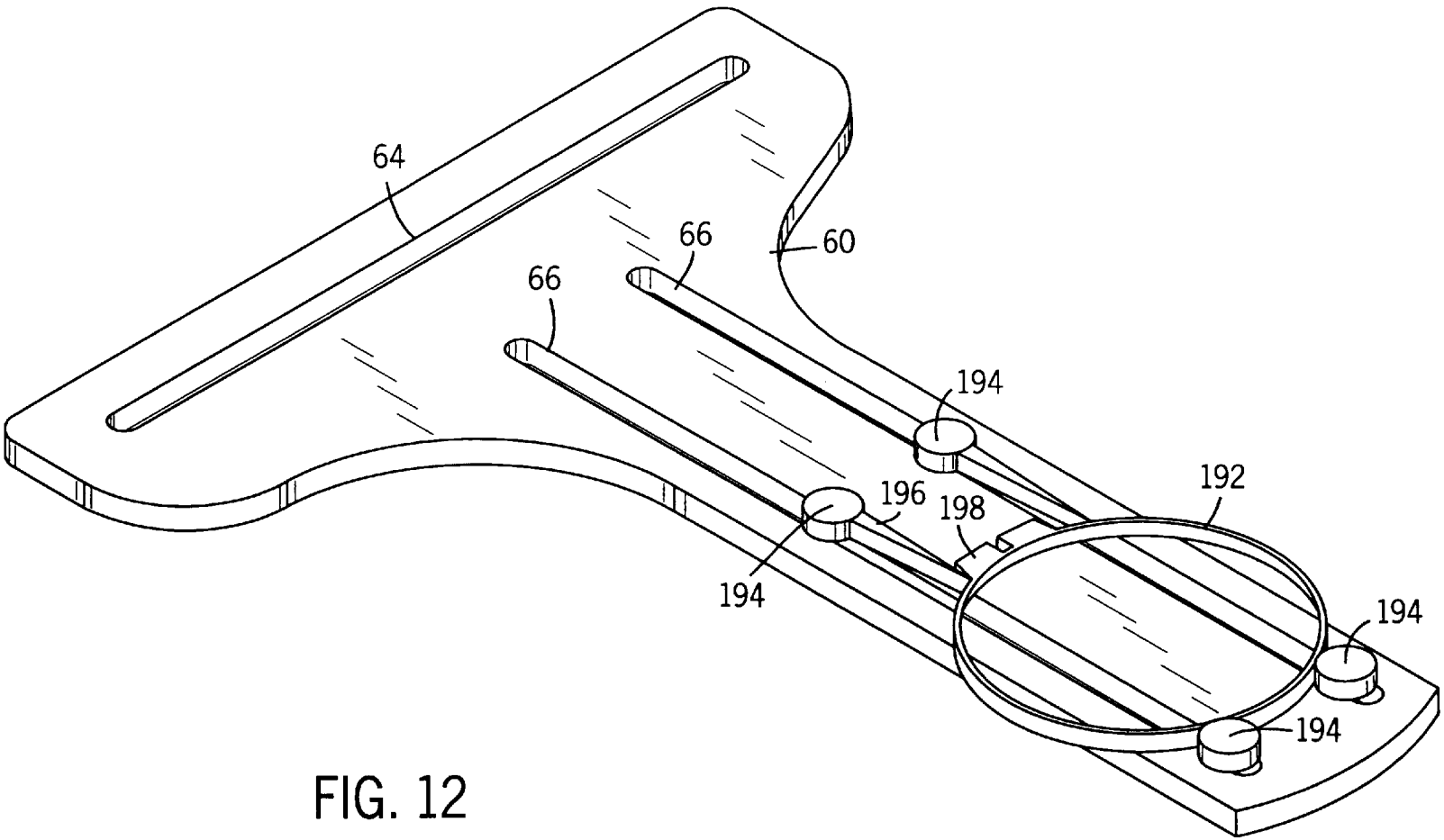
FIG. 12 is a perspective view of the subtable and outer frame half of FIG. 11.

In another embodiment, illustrated in FIGS. 11 and 12, the apparatus has a frame comprising a stand 12, a head assembly 14, a subtable 60 and a single sized inner frame half template (similar to 20A described above). The outer frame half 192 rests on the sleeve subtable 60 and is held in place and manually aligned by threaded pins 194 inserted into the transverse slots 66 in the subtable and threaded into wing nuts (not shown). As shown in FIG. 12, the heads of the pins 194 can have transverse prongs 196 that contact the frame clamp 198 and can be used to laterally center the frame 192. The apparatus is operated by pneumatic or other actuation as described above.

Figure 13:
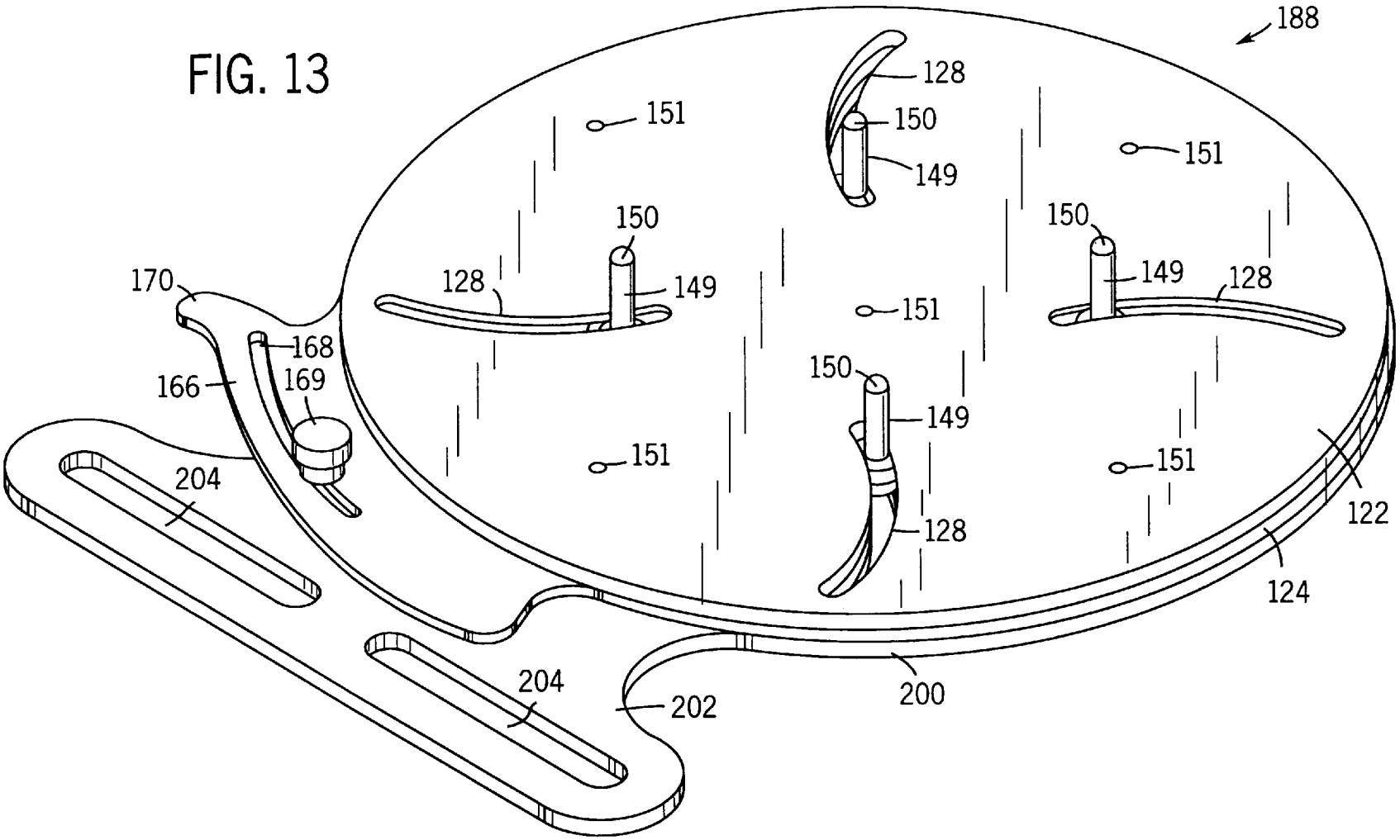
FIG. 13 is a perspective view of the adjustable size outer frame half template of the framing apparatus of FIG. 1 with a table mounting arm.
Figure 14:
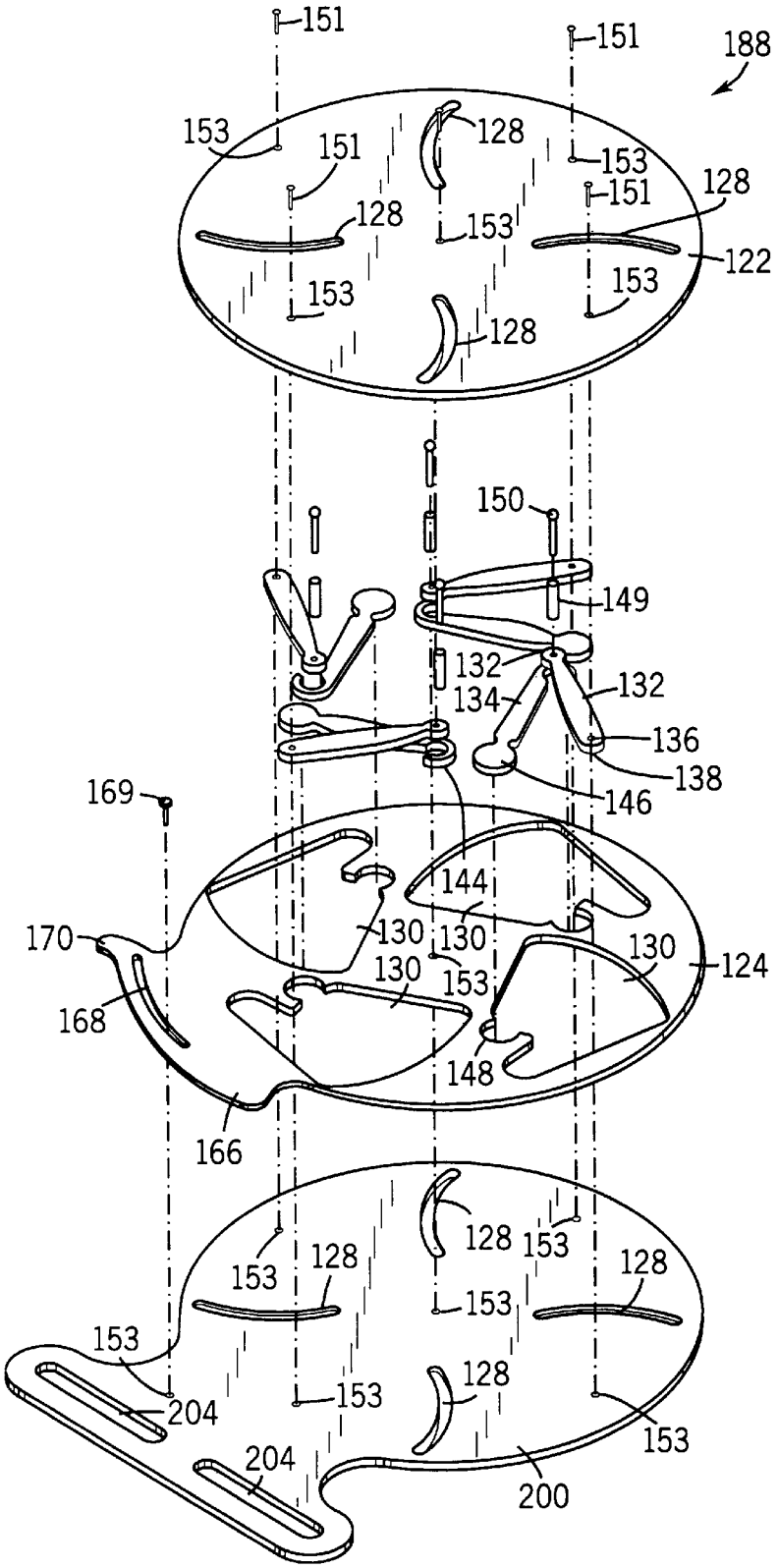
FIG. 14 is an exploded perspective view of the adjustable size outer frame half template of FIG. 13.

In yet another embodiment (not shown), the apparatus has a stand 12, a head assembly 14, and a table assembly 16 to which is mounted an outer frame half template assembly 18B as shown in FIGS. 13 and 14. The outer frame half template assembly 18B is identical to assembly 18 except for the third plate 200. The third plate 200 has a short, generally T-shaped mounting arm 202 containing two lateral slots 204. Threaded stud fasteners 28 may be inserted through the slots 204 and threaded into bores (not shown) in the work table 58 to secure the outer frame half template 18B to the work table 58. Alternatively, the outer frame half template 18B may be secured to any other template support (not shown). The outer frame half template 18B may also be utilized without being secured in place to the work table 58 or other template support (not shown). This embodiment of the outer frame half template 18B is adjusted to accommodate different sized circular frames as described above; however, the outer frame half template 118B must be repositioned to align the outer and inner frame half templates, in the manner described above.

Illustrative embodiments of the invention have been described in considerable detail for the purpose of disclosing practical, operative structures whereby the invention may be practiced advantageously. The designs described are intended to be illustrative only. The novel characteristics of the invention may be incorporated in other structural forms without departing from the scope of the invention as defined in the following claims.

I claim:

1. In an apparatus for applying embroidery frames to a fabric article having:

a machine frame;

a table supported on the machine frame for supporting the fabric article to which an embroidery frame is to be applied;

a first template for positioning a first embroidery frame-half supported by the table beneath fabric of the fabric article; and a second template for holding a second embroidery frame-half above the fabric article, the second template being moveable toward the table so as to apply the second embroidery frame-half to the first embroidery frame-half supported by the table with the fabric of the fabric article between the frame halves;

wherein the second template and the table are supported by the machine frame so as to be adjustable relative to one another so that the position of the table relative to the second template can be adjusted;

the improvement wherein:

the first template is adjustable so as to maintain a common center for differently sized circular first embroidery frame halves, and wherein said adjustable first template comprises a plurality of grips for contacting said first embroidery frame half.

2. The improvement of claim 1, wherein said adjustable first template further comprises at least one linkage connected to said grips and a linkage guide disposed between a frame-half support and a linkage support wherein the linkage guide is adjustable to move the linkage so as to position said grips in contact with said first embroidery frame half.

3. In an apparatus for applying embroidery frames to a fabric article having:

a machine frame;

a table supported on the machine frame for supporting the fabric article to which an embroidery frame is to be applied;

a first template for positioning a first embroidery frame-half supported by the table beneath fabric of the fabric article; and a second template for holding a second embroidery frame-half above the fabric article, the second template being moveable toward the table so as to apply the second embroidery frame-half to the first embroidery frame-half supported by the table with the fabric of the fabric article between the frame halves;

wherein the second template and the table are supported by the machine frame so as to be adjustable relative to one another so that the position of the table relative to the second template can be adjusted;

the improvement wherein:

the first template is adjustable so as to maintain a common center for differently sized circular first embroidery frame halves, and wherein said second template is adjustable so as to hold differently sized second embroidery frame halves having wings extending from a frame-half portion.

4. The improvement of claim 3, wherein said second template comprises:

a tension lever linkage having a plurality of holding pins extending downwardly to contact the edges of said wings so as to hold said differently sized second embroidery frame halves; and a plurality of locator pins adjustable to position said differently sized second embroidery frame halves along a central axis.

5. An adjustable template for positioning differently sized circular embroidery frame halves relative to a common center, comprising:

a frame-half support having an axially facing upper surface which supports a frame-half from an axially facing bottom side of the frame-half;

a plurality of grips extending upwardly from the upper surface of the template, the grips being moveable through the frame-half support so as to vary a distance of each grip from the common center and the grips being adapted to contact a radially facing surface of the frame-half; and a linkage connected to the grips which when adjusted moves the grips in unison while maintaining each grip at approximately equal distances from the common center.

6. An adjustable template for positioning differently sized circular embroidery frame-halves relative to a common center as in claim 5 further comprising:

a linkage guide for containing and adjusting said linkage;

a linkage support having an axially facing upper surface contacting an axially facing bottom surface of the linkage guide and having a tab portion with at least one bore for securing the linkage support to a template support;

a lock for securing the linkage guide to the linkage support so as to fix the position of the grips relative to the common center.

7. An adjustable template for positioning differently sized circular embroidery frame-halves relative to a common center as in claim 5, wherein said linkage comprises sets of first and second links each link having first and second ends.

8. An adjustable template for positioning differently sized circular embroidery frame-halves relative to a common center as in claim 7 wherein said first end of said first links is substantially circular and said first end of said second links is hook-like so as to pivotally trap the circular first end of said first links.

9. An adjustable template for positioning differently sized circular embroidery frame-halves relative to a common center as in claim 8, wherein said linkage guide includes linkage profiles that pivotally trap said second ends of said first and second links so that said second ends each remain at substantially fixed points when said linkage guide is rotated between said frame-half support and linkage support.

10. An adjustable template for positioning relative to a common center different-sized embroidery frame-halves having wings extending from a circular frame-half portion, comprising:

a linkage support having a frame-half portion and extending portions;

first and second transverse links pivotally connected at a center point to the extending portions of the linkage support;

a cross-link pivotally connected end to end to the transverse links;

a plurality of holding pins at the ends of the transverse links extending downwardly from the links beyond the linkage support a distance approximately the thickness of the embroidery frame-half wings;

a tensioning device connected to the linkage support and the first transverse link to pivot the transverse links and bias the holding pins against edges of the embroidery frame-half wings so as to hold the embroidery frame-half; and a plurality of locator pins disposed within slots in the linkage support and adjustable to contact a radial surface of the circular frame-half portion of the embroidery frame-half so as to position differently sized embroidery frame halves at a common center.

* * * * *